US009915158B2

(12) United States Patent
Graf et al.

(10) Patent No.: US 9,915,158 B2
(45) Date of Patent: Mar. 13, 2018

(54) FIRST STAGE TURBINE VANE ARRANGEMENT

(71) Applicant: General Electric Technology GmbH, Baden (CH)

(72) Inventors: Frank Graf, Nussbaumen (CH); Hans-Christian Mathews, Zürich (CH); Fabien Fleuriot, Rosenau (FR); Urs Benz, Gipf-Oberfrick (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 283 days.

(21) Appl. No.: 14/951,253

(22) Filed: Nov. 24, 2015

(65) Prior Publication Data

US 2016/0153294 A1 Jun. 2, 2016

(30) Foreign Application Priority Data

Nov. 27, 2014 (EP) ..... 14195265

(51) Int. Cl.
*F01D 9/02* (2006.01)
*F01D 9/04* (2006.01)
*F01D 11/00* (2006.01)

(52) U.S. Cl.
CPC ..... *F01D 9/04* (2013.01); *F01D 9/023* (2013.01); *F01D 11/005* (2013.01)

(58) Field of Classification Search
CPC ... F01D 9/02; F01D 9/04; F01D 9/023; F01D 11/003; F05D 2240/55; F05D 2240/91
See application file for complete search history.

(56) References Cited

U.S. PATENT DOCUMENTS 5,402,631 A 4/1995 Wolf
5,634,327 A 6/1997 Kamber et al.
6,450,762 B1 9/2002 Munshi
(Continued)

FOREIGN PATENT DOCUMENTS

EP 0 620 363 B1 10/1994
EP 0 718 470 A2 6/1996
(Continued)

OTHER PUBLICATIONS

The Extended European Search Report dated May 20, 2015, issued in corresponding European Patent Application No. 14195265.5-1610. (4 pages).

*Primary Examiner* — Woody Lee, Jr.
*Assistant Examiner* — Sang K Kim
(74) *Attorney, Agent, or Firm* — Buchanan Ingersoll & Rooney PC

(57) ABSTRACT

The disclosure relates to a vane arrangement with a vane carrier, an array of rocking first stage vanes, and an array of frame segments for axially receiving aft ends of a combustor transition pieces. The frame segments comprise an I-beam with an upper horizontal element, a lower horizontal element, a vertical web, a radially outer fixation to the vane carrier, and an arm extending from the lower horizontal element in axial direction below the inner rim segment for supporting the inner platform of the vane and for sealing a gap between the inner platform and the lower horizontal element. Besides the vane arrangement the disclosure relates to a method for assembly of such an arrangement as well as to a gas turbine comprising such a vane arrangement.

12 Claims, 4 Drawing Sheets

(56) References Cited

U.S. PATENT DOCUMENTS

| | | | | |
|---|---|---|---|---|
| 8,105,019 | B2 * | 1/2012 | McCaffrey | F02C 9/22 415/160 |
| 8,356,981 | B2 * | 1/2013 | Cooke | F01D 9/042 416/214 A |
| 8,491,259 | B2 * | 7/2013 | Sutcu | F01D 9/023 415/134 |
| 2006/0288707 | A1 | 12/2006 | Weaver et al. | |
| 2007/0017225 | A1 * | 1/2007 | Bancalari | F01D 9/023 60/752 |
| 2009/0115141 | A1 | 5/2009 | Simmons | |
| 2014/0033728 | A1 | 2/2014 | Marmilic et al. | |

FOREIGN PATENT DOCUMENTS

| | | | | |
|---|---|---|---|---|
| GB | 2061396 A | * | 5/1981 | F01D 11/18 |
| WO | WO 2012/136787 | | 10/2012 | |

* cited by examiner

FIRST STAGE TURBINE VANE ARRANGEMENT

TECHNICAL FIELD

The disclosure relates to first stage vane arrangement for receiving a combustor transition piece which guides hot gases from the combustor to the turbine at the interface from a combustor to a turbine.

BACKGROUND OF THE DISCLOSURE

Gas turbines with can combustors are known from various applications in power plants. Typically a plurality of combustors is disposed in an annular array about the axis of the turbine. Hot combustion gases flow from each combustor through a respective transition piece into the first stage vane. In addition to relative movement, e.g. due to dynamic pulsing between these components, the transition pieces and first stage vane are made of different materials and are subjected to different temperatures during operation, thereby experiencing different degrees of thermal growth. Support frames which support and guide the transition piece at the turbine inlet have been proposed to allow such a "mismatch" at the interface of the transition pieces and the first stage vane. To allow movement between the transition piece and the support frames the US 2009/0115141 A1 suggests the use of sealed slots. The described arrangement is intended to allow radial, circumferential and axial relative movements. However, radial, circumferential and axial relative movements of hot gas path sections relative to each other are difficult to seal and can lead to steps at the interface between the side walls of such an arrangement. These steps are detrimental to the aerodynamics of the turbine, they can cause local high heat loads due to turbulences they might induce in the boundary layer.

SUMMARY OF THE DISCLOSURE

An improved first stage turbine vane arrangement is suggested in order to assure good aerodynamics in the hot gas flow path and reliable cooling. Lifetime is increased and power and efficiency losses due to steps in a hot gas flow path and large cooling gas consumption, as well as increased emissions due to uncontrolled cooling gas flows, are avoided.

The present disclosure relates to a first stage vane arrangement for receiving a combustor transition piece from a can combustor to the turbine inlet adapted to guide combustion gases in a hot gas flow path extending between a gas turbine can combustor and a first stage of turbine. The combustor transition piece comprises a duct having an inlet at an upstream end adapted for connection to the can combustor and an outlet at a downstream end adapted for connection to a first stage of a turbine. Typically each outlet is inserted into a picture frame receptacle formed by a frame segment. The downstream end of the combustor transition piece comprises combustor transition walls. Typically these are an outer wall, an inner wall, as well as two combustor transition side walls.

The inlet of a combustor transition typically has the same cross section as the can combustor to which the transition piece is attached. These can for example be a circular, an oval or a rectangular cross section. The outlet typically has the form of a segment of an annulus. A plurality of combustor transitions installed in the gas turbine form an annulus for guiding the hot gas flow into the turbine.

According to a first embodiment the first stage vane arrangement comprises a vane carrier, an array of first stage vanes, and an array of frame segments for axially receiving aft ends of a combustor transition pieces.

The vanes comprise an outer platform, an inner platform, an airfoil, extending between said outer and inner platforms, an outer suspension for pivotable connection of the vane to the vane carrier. The vanes further comprise an inner rim segment which extends radially inwards from the inner platform.

The frame segments comprise an I-beam with an upper horizontal element, a lower horizontal element, and a vertical web, and a fixation to the vane carrier. From the lower horizontal element at least one arm extends in axial direction below the inner rim segment for supporting the inner platform of the vane and for sealing a gap between the inner platform and the lower horizontal element.

The pivotable connection is arranged such that the vane can rock around an axis which is normal to the longitudinal direction of the airfoil, i.e. the direction from inner platform to outer platform, and normal to the axial direction of the gas turbine when the vane is installed in a turbine. Such a pivotable vane is also called rocking vane.

The pivotable connection can for example be a projection extending against the axial direction from a vertical wall of the vane carrier into a notch in a vertical side wall of the outer platform, or a projection extending in axial direction from a vertical side wall of the outer platform into a notch in a vertical side wall of the vane carrier. The vertical direction is the direction from the inner platform to the outer platform of the vane. A side wall is a wall terminating in axial direction, i.e. a wall in a plane normal to the axis of the gas turbine.

The arm which is extending from the lower horizontal element below the inner rim segment for supporting the inner platform of the vane facilitates the alignment of inner platform of the rocking vane with exit of a combustor transition piece which can be axially inserted into the frame segments.

According to a further embodiment of the first stage vane arrangement an outer rim segment extends radially outwards from the arm. The outer rim limits the axial movement of the vane relative to the lower horizontal element. In addition the combination of outer rim and inner rim improves the sealing in a labyrinth like manner.

More specifically the outer rim segment and the arm form an L-shaped hock for supporting the rocking vane wherein the inner rim engages in the hock.

In another embodiment of the first stage vane arrangement an inner seal is attached to an outer face of the arm for sealing a gap between the inner rim segment and the arm. Alternatively or in combination an inner seal can be attached to an inner face of the inner platform for sealing a gap between the outer rim segment and the inner platform. An outer face is a surface facing radially away from the axis of the gas turbine when the arrangement is installed in a gas turbine and an inner face is a surface facing radially inwards.

According to a further embodiment of the first stage vane arrangement an inner seal is arranged between the sides of the inner rim segment and the outer rim segment which are facing each other. Alternatively or in combination an inner seal is arranged between the sides of the inner rim segment and the lower horizontal element which are facing each other.

The inner seal can be configured as a honeycomb seal. According to one embodiment the webs of the honeycombs of the inner seal are orientated parallel to the outer face of the arm. Thus the webs can deflect easily if a force is imposed on them by the inner rim segment. The honeycomb can act as a spring closing the gap. The inner rim, respectively the honeycomb with the inner rim segment can hold the rocking vane into a preferred position.

In a further embodiment the fixation for mounting the frame segment to vane carrier comprises at least one ear. The ear can be attached radially outwards of the upper horizontal element for bolting the frame segment to the vane carrier.

According to yet another embodiment of the first stage vane arrangement the outer horizontal element has a mounting face and the vane carrier has matching mounting face for mounting the frame segment to the vane carrier in a substantially gas tight manner. For gas tight mounting the mounting faces can have substantially flat smooth facing each other and which are pressed onto each other during assembly.

In a more specific embodiment a seal is arranged between the mounting face of the outer horizontal element and the matching mounting face of the vane carrier. The seal can for example be a rope seal. A notch in circumferential direction around the axis of the gas turbine can be provided in the mounting face of the outer horizontal element or in the mounting face of the vane carrier for receiving the rope seal.

In another embodiment the first stage vane arrangement comprises a combustor transition piece with a duct having an inlet at an upstream end adapted for connection to a combustor, and an outlet at an aft end wherein the aft end is adapted for axial insertion into a frame formed by two neighboring frame segments. To reduce cooling air leakages a seal is arranged between the outer surface of the combustor transition wall of the combustor transition piece's aft end and the surface of the frame segment facing the combustor transition wall of the combustor transition piece.

The seal can for example be arranged in a plane normal to the axis of the gas turbine and spanning around the outside of the combustor transition piece.

According to a further embodiment the seal between combustor transition wall and the frame segment is an E-seal. The E seal can be inserted between two strips which span around the combustor transition wall and which are axially displaced to define a slot. Alternatively two strips can also extend from the frame segment towards the combustor transition wall. These can also be axially displaced to define a slot for receiving the E-seal. The strips can be an integral part of the combustor transition wall, respectively of the frame segment, or attached to it.

Further, a gas turbine comprising such a first stage vane arrangement is an object of the disclosure. The proposed gas turbine has at least one compressor, at least one turbine, and at least one can combustor with a transition piece and a first stage vane arrangement according to the disclosure.

In addition to the first stage vane arrangement and a gas turbine comprising such a first stage vane arrangement a Method for assembly of a first stage vane arrangement is a subject of the disclosure.

The method for assembly of a first stage vane arrangement comprises the steps of

- providing a first stage vane arrangement with a vane carrier, an array of first stage vanes, and an array of frame segments for axially receiving aft ends of a combustor transition pieces;
- mounting the vanes to the vane carrier by engaging the outer suspension in a pivotable connection,
- engaging the arm of the lower horizontal element to the inner rim segment from a radially inner position, and
- pushing the frame segments against vane carrier and mounting the outer fixation to the vane carrier.

In such a first stage vane arrangement the vanes comprise an outer platform, an inner platform, an airfoil, extending between said outer and inner platforms. The vanes have an outer suspension for pivotable connection of the vane to the vane carrier, and an inner rim segment which is extending radially inwards from the inner platform.

In such a first stage vane arrangement the frame segments comprise an I-beam with an upper horizontal element, a lower horizontal element, a vertical web, and an outer fixation to the vane carrier. For supporting the inner platform of the vane and for sealing a gap between the inner platform and the lower horizontal element an arm is extending from the lower horizontal element in axial direction below the inner rim segment.

The above described combustor transition, can combustor and gas turbine can be a single combustion gas turbine or a sequential combustion gas turbine as known for example from EP 0 620 363 B1 or EP 0 718 470 A2. It can also be a combustor transition of a gas turbine with one of the combustor arrangements described in the WO 2012/136787.

BRIEF DESCRIPTION OF THE DRAWING

The invention, its nature as well as its advantages, shall be described in more detail below with the aid of the accompanying drawings. Referring to the drawings.

EMBODIMENTS OF THE DISCLOSURE

The same or functionally identical elements are provided with the same designations below. The examples do not constitute any restriction of the invention to such arrangements.

Figure 1A:
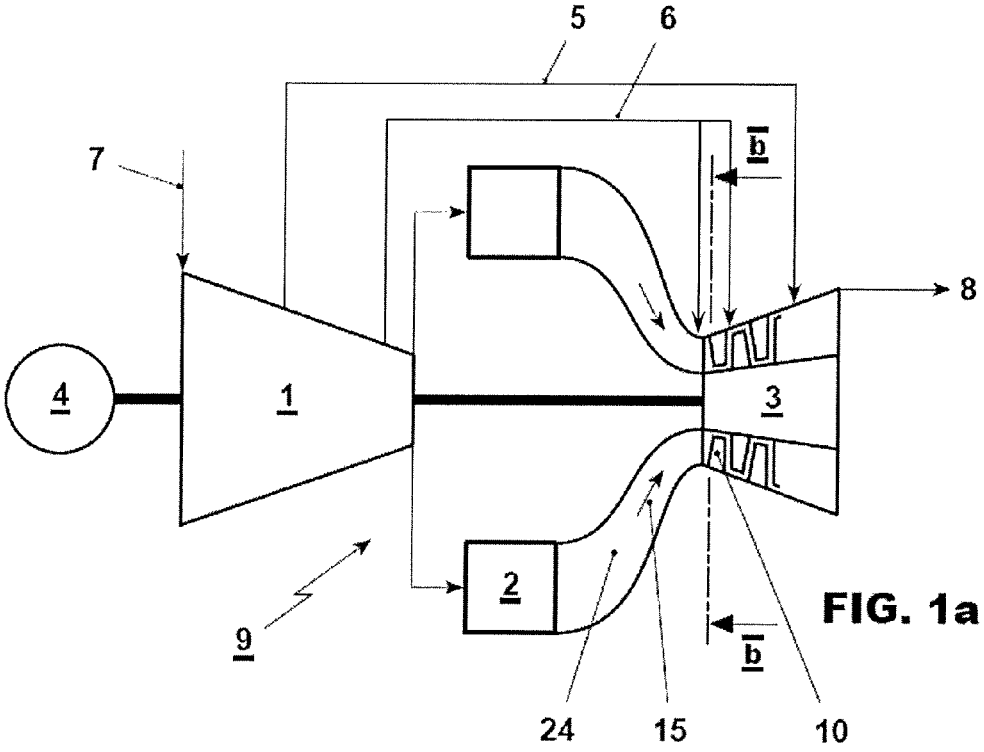
FIG. 1*a* shows an example of a gas turbine according to the present invention.

An exemplary arrangement is shown in FIG. 1*a*. The gas turbine 9 is supplied with compressor inlet gas 7. In the gas turbine 9 a compressor 1 is followed by a combustion chamber comprising a plurality of can combustors 2. Hot combustion gases are fed into a turbine 3 via a plurality of combustor transition pieces 24. The can combustors 2 and combustor transition pieces 24 form a hot gas flow path 15 leading to the turbine 3. The combustor transition pieces 24 connect the can combustors 2 of the combustion chamber with the first stage vane 10 of the turbine 3.

Cooling gas 5, 6 is branched off from the compressor 1 to cool the turbine 3, the combustor 2 (not shown) and a frame segment (not shown in FIG. 1). In this example the cooling systems for high pressure cooling gas 6 and low pressure cooling gas 5 are indicated.

Exhaust gas 8 leaves the turbine 3. The exhaust gas 8 is typically used in a heat recovery steam generator to generate steam for cogeneration or for a water steam cycle in a combined cycle (not shown).

Figure 1B:
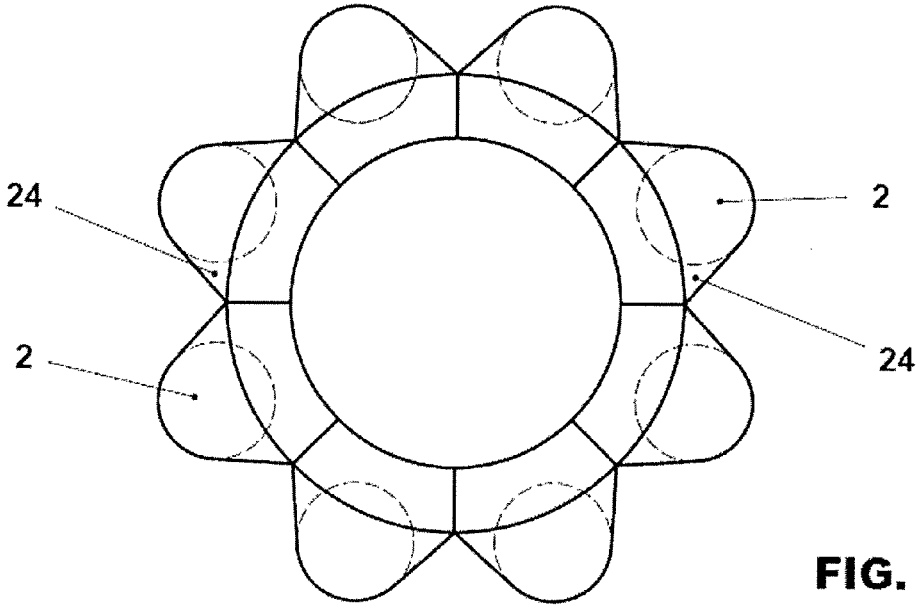
FIG. 1*b* shows the cross section b-b of the turbine inlet with combustor transitions of the gas turbine from FIG. 1*a*.

The combustor transition pieces 24 of the gas turbine 9 of the cross section B-B are shown in FIG. 1*b*. The combustor transition pieces 24 guide the hot gases from the can combustors 2 to the turbine 3 and are arranged to form an annular hot gas duct at the turbine inlet.

Figure 1C:
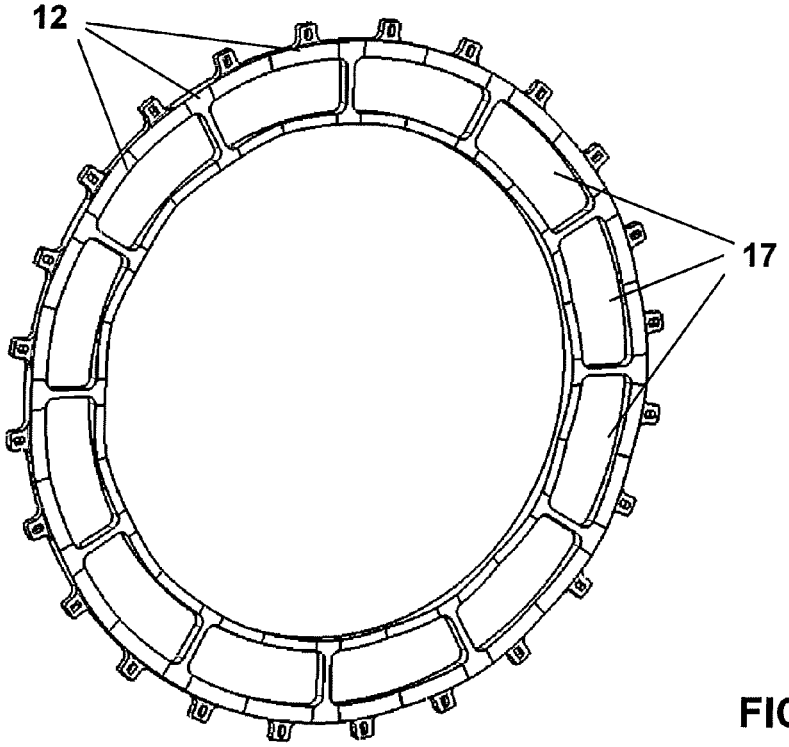
FIG. 1*c* shows an example of an annular arrangement of frame segments for receiving the aft ends of the transition pieces shown in FIG. 1*b*.

FIG. 1*c* shows an example of an annular arrangement of frame segments 12 for receiving the aft ends of the combustor transition pieces 24. Neighboring pairs of frame segments 12 form a picture frame receptacle 17 which can receive an aft end or outlet of a combustor transition piece (not shown).

Figure 2:
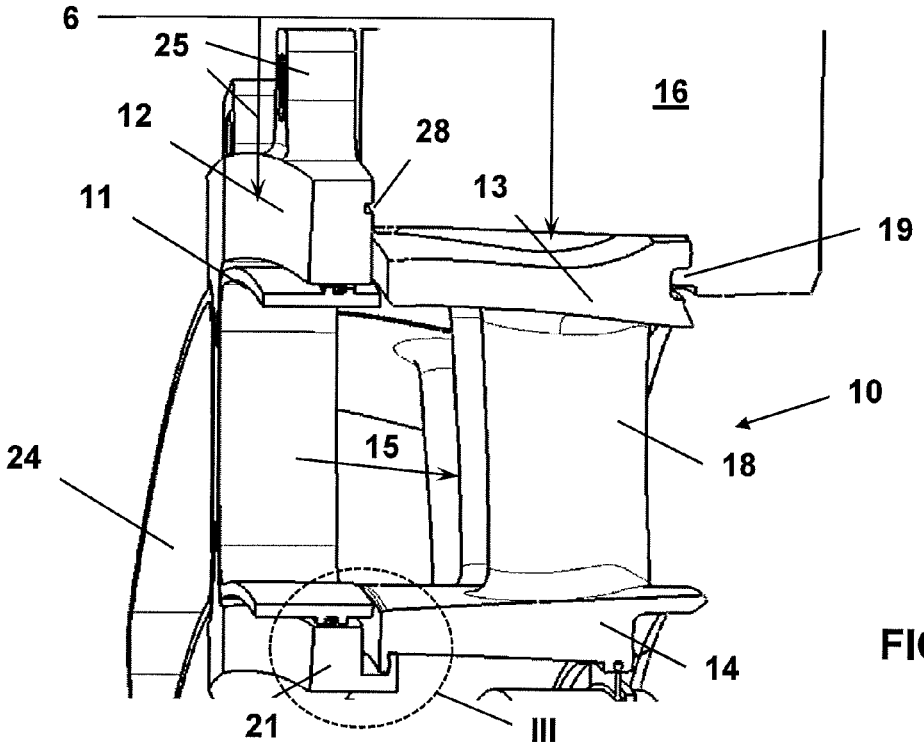
FIG. 2 shows the outlet of a combustor transition piece inserted in a frame segment together with a supporting vane carrier and a first stage vane of a turbine.

An example for the interface between combustor transition piece 24 and the first stage vane 10 of a turbine 3 is shown in more detail in FIG. 2. The combustor transition piece 24 is defined by the combustor transition wall 11, which confines the hot gas flow path 15. At the outlet of the combustor transition piece 24 the cross section of each combustor transition piece has the geometrical shape of a sector of the annulus, which forms the hot gas flow path 15 at the turbine inlet. The hot gas flow path 15 continues into the space between the first stages vanes 10 of the turbine 3. The inner platforms 14 and outer platforms 13 delimit the hot gas flow path 15 in the turbine inlet. The airfoils 18 of the turbine vanes 10 extend in radial direction between the inner platform 14 and outer platform 13 of the vane 10 and at least partly divide the hot gas flow path 15 in the circumferential direction. At the outlet to the turbine (also called aft end) the combustor transition pieces 24 are supported and kept in their position by frame segments 12. The frame segments 12 and the first stage vanes 10 are supported by and fixed to a vane carrier 16. High pressure cooling gas can be supplied to the frame segments 12 and first stage vanes 10. A seal 33 is arranged between the outside of the combustor transition wall 11 and the receiving frame segments 12. The gap between the combustor transition wall 11 and the receiving frame segments 12 is typically pressurized with cooling gas. The seal 33 prevents unnecessary loss of cooling gas through this gap into the hot gas flow path 15.

A front seal 28 can be installed between the frame segment 12 and the vane carrier 16.

The sealing and supporting interface between the lower horizontal element 21 and the inner platform 14 is indicated by the dotted circle III and shown in more detail in FIG. 3.

FIG. 3 shows a close-up of an example of a frame segment's lower horizontal element 21 with seal and support interface to the inner platform 14 of a vane 10 (encircled as section III in FIG. 2) and wall seal 33 arranged between the combustor transition wall 11 and the frame segment 12.

Two strips 34 extend from the combustor transition wall 11 into the gap between the combustor transition wall 11 and the frame segment 12 (here only shown at the section between the wall and the lower horizontal element 21) and span around the combustor transition wall 11. They are axially displaced to define a slot in which an E-seal 33 is inserted. The seal allow axial movement of the combustor transition wall 11 relative to the frame segment 12 and seals the gap between the two pieces.

In this example an arm 26 extends from the lower horizontal element 21 in axial direction towards the inner platform 14 (of the gas turbine when the segment is installed). At the axial end of the arm 26 an outer rim segment 27 extends radially outwards in the direction of an inner face 31 of the inner platform 14. The arm 26 with the outer rim segment 27 form an L-shaped hook. This L-shaped hocks behind the inner rim segment 23 which extends radially inwards at an upstream end from the inner face 31 of the inner platform 14.

The inner platforms 14 of all vanes of the first turbine stage form a ring. The inner faces 31 of the inner platforms 14 from a cylindrical inner face. The outer rim segments 27 of all frame segments form a ring which fits into the cylinder formed by the inner platforms 14. It is sealing a space below the inner platform 14 and the hot gas flow path above the inner platform 14. In addition the outer rim segments 27 support the inner platform 14 and can keep it in the correct position aligned with the aft end of the combustor transition wall 11.

As shown in the close-up view in FIG. 3*a* an inner seal 29 can be attached to outer face 30 of the arm 26, i.e. the side of the arm 26 which is facing towards the inner rim segment 23 for better sealing. During assembly the inner rim segment 23 is pressed against the inner seal 29. In this arrangement radial forces are transferred via the outer rim segment 27 to the inner face 31 of the inner platform. In the example shown the inner seal 29 is configured as a honeycomb seal with the webs oriented in radial direction.

Figure 3C:
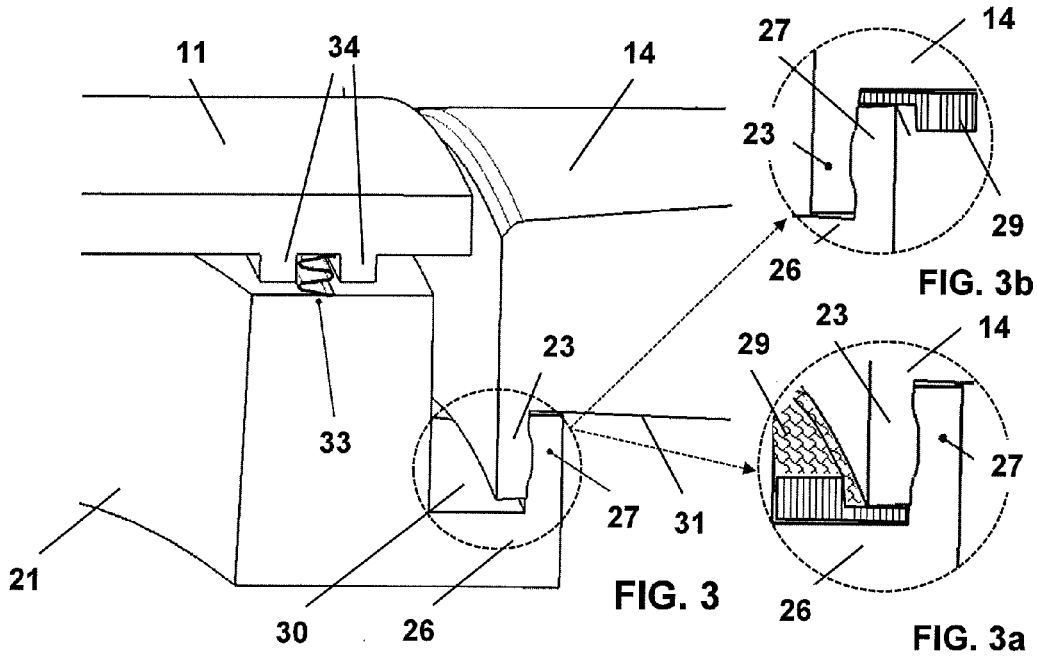
FIG. 3 shows an example of a frame segment's lower horizontal element with the seal and support interface to the inner platform of a vane.
FIGS. 3*a*, 3*b*. 3*c*, 3*d*, and 3*e* show details of a seal between a frame segment and an inner platform.
Figure 3C:
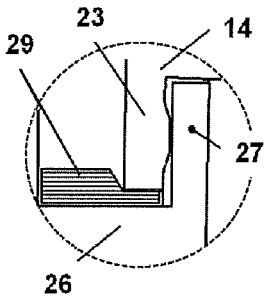

FIG. 3*c* is based on FIG. 3*a*. In this example the webs of the honeycombs of the inner seal 29 are orientated parallel to the outer face 30 of the arm 26. Thus the webs can deflect more easily if a force is imposed on them by the inner rim segment 23. The honeycomb can act as a spring closing the gap and pushes the rocking vane 10 into a preferred position.

Alternatively an inner seal 29 can be attached to inner face 31 of the inner platform 14 next to the inner rim segment 23 for better sealing. During assembly the outer rim segment 27 is pressed against the inner seal 29. In this arrangement radial forces are transferred via the inner rim segment 23 to the outer face 30 of the arm 26. An example for such a configuration is shown in the close-up view in FIG. 3*b*. In the example shown the inner seal 29 is configured as a honeycomb seal.

Figure 3D:
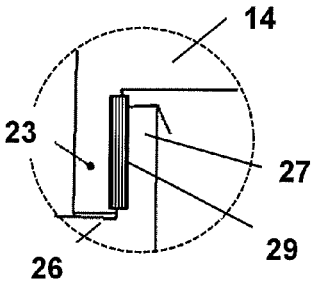

FIG. 3*d* shows another alternative. Here the inner seal 29 is arranged between the sides of the inner rim segment 23 and the outer rim segment 27 which are facing each other.

Figure 3E:
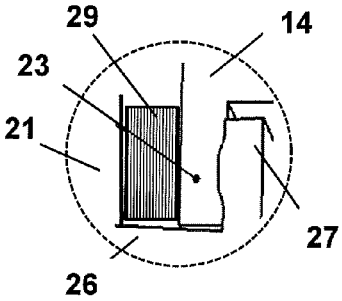

FIG. 3*e* shows yet another alternative. Here the inner seal 29 is arranged between the sides of the inner rim segment 23 and the lower horizontal element 21 which are facing each other.

In FIGS. 3*d* and 3*e* the inner seal is configured as a honeycomb with webs orientated parallel to the inner ring segment's 23 surface. Thus the webs can deflect more easily if a force is imposed on them by the inner rim segment 23. The honeycomb can act as a spring closing the gap and pushes the rocking vane 10 into a preferred position.

Figure 4:
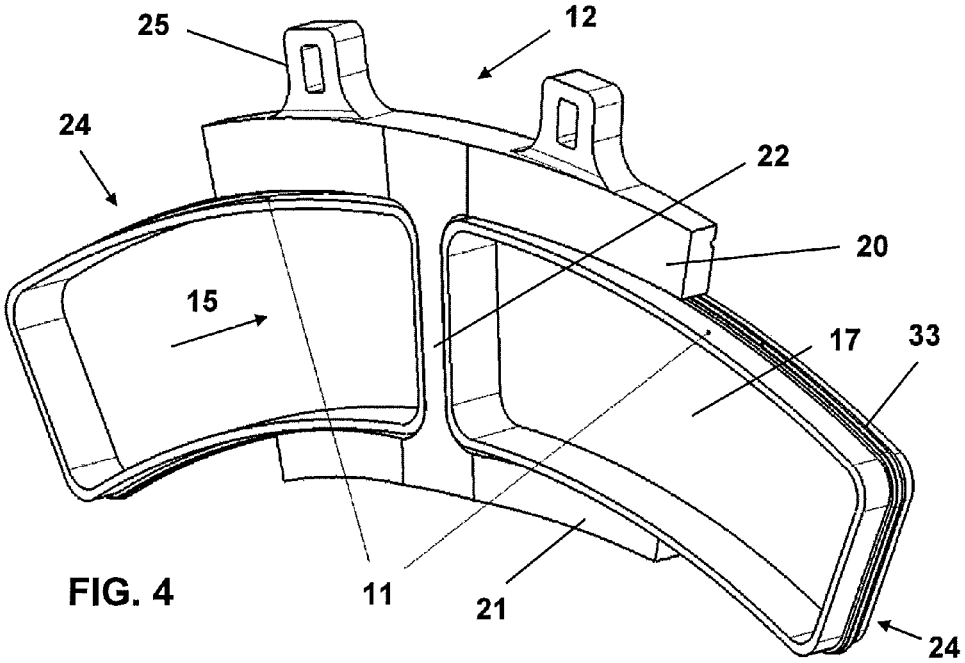
FIG. 4 shows an example of a frame segment with two transition pieces inserted.

FIG. 4 shows a perspective view of an example of a frame segment 12 with two combustor transition pieces 24 inserted. The frame segment 12 consist of a vertical web 22 with an upper horizontal element 20 arranged radially outside of the vertical web 22, and a lower horizontal element 21 arranged radially inside of the vertical web 22 when installed in a gas turbine. The frame segment 12 comprises two ears 25 for fixation to a vane carrier. They extend in radial direction from the upper horizontal element 20. The combustor transition pieces 24 open in flow direction on both sides of the downstream end of the vertical web 22.

Figure 5:
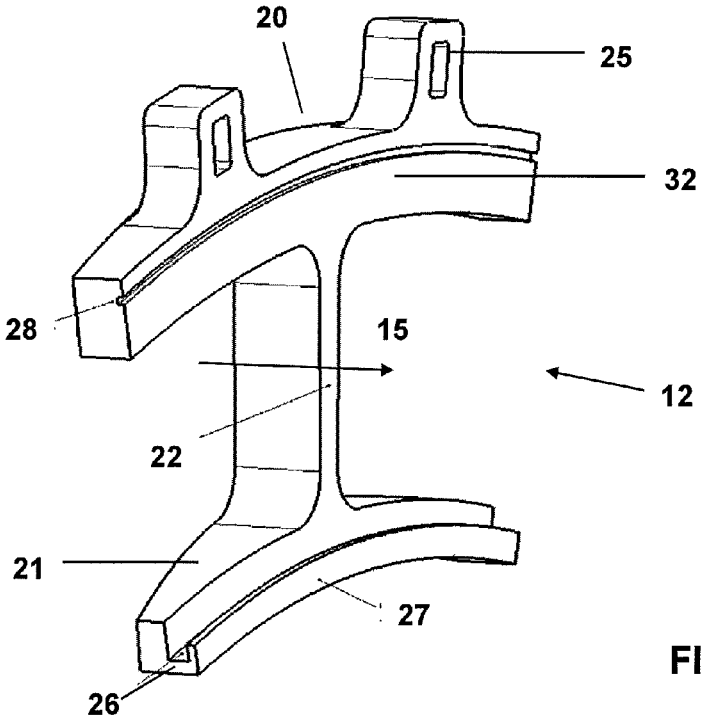
FIG. 5 shows another perspective view of an example of a frame segment of FIG. 4.

FIG. 5 shows another perspective view of an example of a frame segment 12 of FIG. 4. The FIG. 5 shows a mounting face 32 of the upper horizontal element 20 which is facing in downstream direction of the hot gas flow 15 towards the vane carrier for attachment to the vane carrier. In the mounting face 32 a front seal 28 is indicated. The front seal 28 can be kept in a seal grove. The seal spans in circumferential direction around the axis of the gas turbine. When installed the front seals 28 form a ring spanning around the annular hot gas flow path and seal the interface between the frame segments and the vane carrier. The front seal 28 can for example be a rope seal.

LIST OF DESIGNATIONS

1 Compressor
2 Can combustor
3 Turbine
4 Generator
5 Low pressure cooling gas
6 High pressure cooling gas
7 Ambient air
8 Exhaust gas
9 Gas turbine
10 Vane
11 Combustor transition wall
12 Frame segment
13 Outer platform
14 Inner platform
15 Hot gas flow path
16 Vane carrier
17 Picture frame receptacle
18 Airfoil
19 Suspension
20 Upper horizontal element
21 Lower horizontal element
22 Vertical web
23 Inner rim segment
24 Combustor transition piece
25 Fixation
26 Arm
27 Outer rim segment
28 Front seal
29 Inner seal
30 Outer face
31 Inner face
32 Mounting face
33 Seal
34 Strip

The invention claimed is:

1. A first stage vane arrangement with a vane carrier, an array of first stage vanes, and an array of frame segments for axially receiving aft ends of a combustor transition pieces, the first stage vanes comprising: an outer platform, an inner platform, an airfoil, extending between said outer platform and inner platform, an outer suspension for pivotable connection of the vane to the vane carrier, and an inner rim segment extending radially inwards from the inner platform, the frame segments comprising: an I-beam with an upper horizontal element, a lower horizontal element, a vertical web, a fixation to the vane carrier, and an arm extending from the lower horizontal element in axial direction below the inner rim segment for supporting the inner platform of the vane and for sealing a gap between the inner platform and the lower horizontal element.

2. A first stage vane arrangement according to claim 1, wherein an outer rim segment extends radially outwards from the arm.

3. A first stage vane arrangement according to claim 2, wherein an outer rim segment and the arm form a L-shaped hook for supporting the pivotable vane.

4. A first stage vane arrangement according to claim 1, wherein an inner seal is arranged between an outer face of the arm and the inner rim segment for sealing a gap between the inner rim segment and the arm and/or in that an inner seal is arranged between an inner face of the inner platform and the outer rim segment for sealing a gap between the outer rim segment and the inner platform.

5. A first stage vane arrangement according to claim 1, wherein an inner seal is arranged between the sides of the inner rim segment and the outer rim segment which are facing each other and/or that an inner seal is arranged between the sides of the inner rim segment and the lower horizontal element which are facing each other.

6. A first stage vane arrangement according to claim 1, wherein the fixation for mounting the frame segment to vane carrier comprises at least one ear.

7. A first stage vane arrangement according to claim 1, wherein the outer horizontal element has a mounting face and in that the vane carrier has matching mounting face for mounting the frame segment to the vane carrier in a substantially gas tight manner.

8. A first stage vane arrangement according to claim 7, wherein a front seal is arranged between the mounting face of the outer horizontal element and the matching mounting face of the vane carrier.

9. A first stage vane arrangement according to claim 1, comprising a combustor transition piece with a duct having an inlet at an upstream end adapted for connection to a combustor, an outlet at an aft end wherein the aft end is adapted for axial insertion into a frame formed by two neighboring frame segments, and wherein a wall seal is arranged between the outer surface of the combustor transition wall of the combustor transition piece aft end and a surface of the frame segment facing the wall of the combustor transition piece.

10. A first stage vane arrangement according to claim 9, wherein the wall seal between combustor transition wall and the frame segment is an E-seal.

11. A gas turbine with at least one compressor, at least one turbine, and at least one combustion chamber with a combustor transition piece, comprising the first stage vane arrangement according to claim 1.

12. A method for assembly of a first stage vane arrangement comprising the steps of providing a first stage vane arrangement with:

a vane carrier, an array of first stage vanes, and an array of frame segments for axially receiving aft ends of a combustor transition pieces, the vanes comprising: an outer platform, an inner platform, an airfoil, extending between said outer platform and inner platform, an outer suspension in a pivotable connection of the vane to the vane carrier, and an inner rim segment extending radially inwards from the inner platform, the frame segments comprising an I-beam with an upper horizontal element, a lower horizontal element, a vertical web, a fixation to the vane carrier, and an arm extending from the lower horizontal element in axial direction below the inner rim segment for supporting the inner platform of the vane and for sealing a gap between the inner platform and the lower horizontal element, mounting the vanes to the vane carrier by engaging the outer suspension for pivotable connection, engaging the arm of the lower horizontal element to the inner rim segment from a radially inner position, pushing the frame segments against vane carrier and mounting the fixation to the vane carrier.

* * * * *